US007425010B2

(12) United States Patent
Harris

(10) Patent No.: US 7,425,010 B2
(45) Date of Patent: Sep. 16, 2008

(54) MOUNT FOR A WHEELCHAIR FOOTREST

(75) Inventor: Vince Harris, Dallas, PA (US)

(73) Assignee: Pride Mobility Products Corporation, Exeter, PA (US)

( * ) Notice: Subject to any disclaimer, the term of this patent is extended or adjusted under 35 U.S.C. 154(b) by 333 days.

(21) Appl. No.: 11/252,118

(22) Filed: Oct. 17, 2005

(65) Prior Publication Data

US 2006/0082098 A1 Apr. 20, 2006

Related U.S. Application Data

(60) Provisional application No. 60/619,704, filed on Oct. 18, 2004.

(51) Int. Cl.
*A61G 5/10* (2006.01)

(52) U.S. Cl. ..... 280/304.1; 297/423.26; 297/423.55; 297/423.37

(58) Field of Classification Search ..... 280/304.1; 297/423.26, 423.35, 423.37
See application file for complete search history.

(56) References Cited

U.S. PATENT DOCUMENTS

| | | | | |
|---|---|---|---|---|
| 3,337,261 | A | 8/1967 | Nihlean et al. | |
| 3,376,067 | A | 4/1968 | Kernes | |
| 3,790,212 | A | 2/1974 | Suyetani | |
| 3,854,774 | A | 12/1974 | Limpach | |
| 3,990,744 | A | 11/1976 | Rodaway | |
| 4,076,304 | A | 2/1978 | Deucher | |
| 4,174,852 | A | 11/1979 | Panzica et al. | |
| 4,462,604 | A | 7/1984 | Meyer | |
| 4,593,929 | A | 6/1986 | Williams | |
| 4,770,467 | A | 9/1988 | Zinn | |
| 4,813,639 | A | 3/1989 | Midkiff et al. | |
| 4,834,413 | A | 5/1989 | Patel et al. | |
| 5,209,509 | A | 5/1993 | Gay et al. | |
| 5,228,747 | A * | 7/1993 | Greene | 297/284.3 |
| 5,261,684 | A * | 11/1993 | Soto | 280/250.1 |
| 5,393,082 | A | 2/1995 | Fenley | |
| 5,522,644 | A | 6/1996 | Peek | |
| 6,196,565 | B1 | 3/2001 | Chubbuck | |
| 6,217,050 | B1 | 4/2001 | Dickie et al. | |

(Continued)

OTHER PUBLICATIONS

Quickie or Sunrise Medical, "Accessorize Your Life" brochure (copyright date 2002).

(Continued)

*Primary Examiner*—Lesley D. Morris
*Assistant Examiner*—Marlon A Arce Diaz
(74) *Attorney, Agent, or Firm*—DLA Piper US LLP

(57) ABSTRACT

A wheelchair footrest is provided having a footrest support member and a socket receptacle connected thereto. A swivel element is adjustably received for rotation within the socket receptacle. A foot plate is connected to the swivel element by a foot plate support member. The position of the swivel element is rotatably adjustable relative to the socket receptacle in yaw, pitch and roll directions. The swivel element has a socket engaging surface forming a portion of a sphere and the socket receptacle has an interior surface sized and shaped to mate with the socket engaging surface. The socket receptacle and the swivel element are fabricated from ferrous metals, and at least the interior surface of the socket receptacle and the socket engaging surface of the swivel element are subjected to a ferritic nitrocarburization surface treatment process.

23 Claims, 6 Drawing Sheets

U.S. PATENT DOCUMENTS

| | | | | |
|---|---|---|---|---|
| 6,422,653 | B1 | 7/2002 | Szczepanski et al. | |
| 6,425,635 | B1 | 7/2002 | Pulver | |
| 6,450,581 | B1 | 9/2002 | Koerlin | |
| 6,543,854 | B1 | 4/2003 | Finch | |
| 7,331,632 | B2 | 2/2008 | Wendt | 297/423.19 |
| 2003/0075967 | A1 | 4/2003 | Ciolfe et al. | |
| 2003/0178880 | A1* | 9/2003 | Hannah | 297/406 |
| 2004/0075327 | A1 | 4/2004 | Adams | |

OTHER PUBLICATIONS

Sunrise Medical—Manual Products Parts Manual—"Footrests" (dated Feb. 2003), pp. 14.1-14.33.

* cited by examiner

MOUNT FOR A WHEELCHAIR FOOTREST

CROSS REFERENCE TO RELATED APPLICATION

This application claims priority from U.S. Provisional Patent Application No. 60/619,704, filed Oct. 18, 2004.

FIELD OF THE INVENTION

The present invention relates to footrests for vehicles, such as manual or powered wheelchairs.

BACKGROUND OF THE INVENTION

It is known to provide wheelchairs with footrests. Generally, footrests are used in wheelchairs to support the user's feet and keep them elevated above the supporting surface. Footrests, however, may get in the way of the user's ingress and egress of the wheelchair. Therefore, it is known to have footrests that are positionable out of the way of a user. It is also known to have footrests on a wheelchair that rotate about an axis from a usable position to a storage position. Additionally, there are various required positions of the footrest required for the comfort of users of different shapes and sizes. To address this problem, some wheelchairs have been constructed with adjustable footrests. However, greater comfort and convenience from a wheelchair's footrest can be obtained when the footrest has various degrees of adjustability. It is believed that a wheelchair footrest providing multiple degree of freedom positional adjustment capability would be desirable.

SUMMARY OF THE INVENTION

In a first aspect, the invention is a wheelchair footrest for use with a wheelchair, comprising a footrest support member connectable to a frame of the wheelchair. A socket receptacle is fixedly connected to the footrest support member. A swivel element is releasably and adjustably received for rotation within the socket receptacle. A foot plate is provided, and a foot plate support member is connected to the swivel element and further connected to the foot plate. The position of the swivel element is rotatably adjustable relative to the socket receptacle in yaw, pitch and roll directions. The swivel element may be rotatably adjustable relative to the socket in each of the yaw, pitch, or roll directions over an angular range of at least 50 degrees (plus and minus 25 degrees about a central position).

In another aspect of the invention, the swivel element has a socket engaging surface forming a portion of a sphere and the socket receptacle has an interior surface sized and shaped to mate with the socket engaging surface. Also, the socket receptacle and the swivel element are preferably fabricated from ferrous metals. The interior surface of the socket receptacle and the socket engaging surface of the swivel element further may be subjected to a ferritic nitrocarburization surface treatment process.

BRIEF DESCRIPTION OF THE DRAWINGS

For the purpose of illustrating the invention, a preferred embodiment of the invention is shown in the drawings; it being understood, however, that this invention is not limited to the precise arrangements and instrumentalities shown.

DETAILED DESCRIPTION OF THE INVENTION

Figure 1:
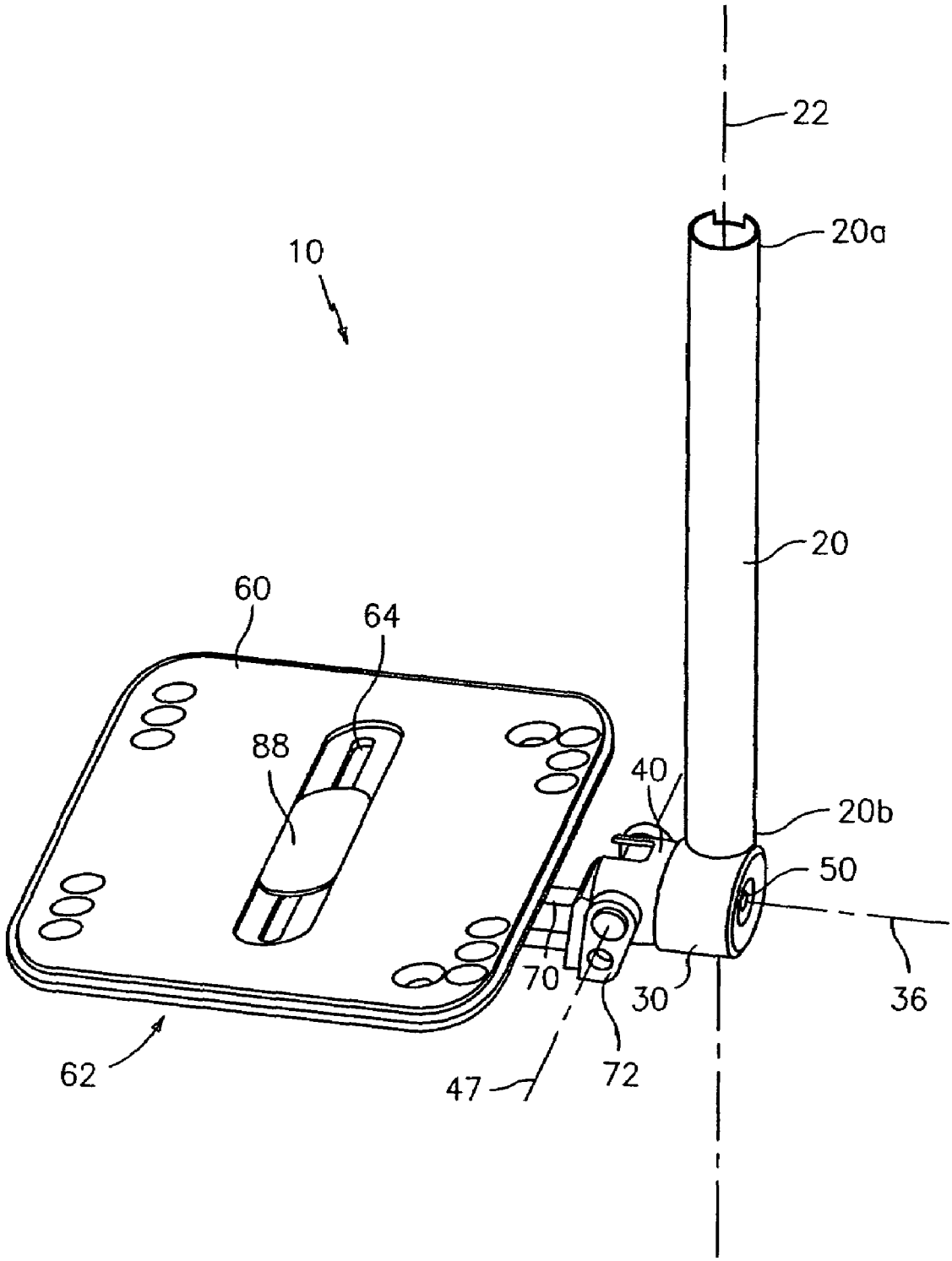
FIG. 1 is a top perspective view of a wheelchair footrest in accordance with a preferred embodiment of the present invention, having a foot plate shown in a lowered, operative position.

Referring to the drawings, where like numerals identify like elements, throughout a footrest assembly (or "footrest" 10) is generally identified by the reference numeral 10 (in FIGS. 1-8). The footrest 10 comprises a footrest support member 20, a socket receptacle 30, a swivel element 40, a foot plate 60, and a foot plate support member 70. Preferably, the footrest 10 is used in combination with a wheelchair (not illustrated).

With particular reference to FIGS. 1-5, the footrest support member 20 is preferably an elongated tubular member having a first end 20*a* and a second end 20*b*. A support member axis 22 extends longitudinally from the first end 20*a* to the second end 20*b*. Preferably, the first end 20*a* of the footrest support member 20 is connected to a frame or a leg rest support attached to the frame of the wheelchair (not illustrated). Attachments may be made, for example, to a support by means of a projection that slideably fits within a T-slot on the frame or the support. Other structures may also be used. Alternatively, the footrest support member 20 could be formed integrally and unitarily with the wheelchair frame (not illustrated). Those skilled in the art will recognize that many attachment means may be used to connect the footrest support members to a wheelchair without departing from the scope of the present invention.

The socket receptacle 30 is preferably fixedly connected to the footrest support member 20 at a point proximate the second end 20*b*. The socket receptacle 30 has an interior surface 34 sized and shaped to mate with a socket engaging surface 42, described herein below. Preferably, the socket receptacle 30 is generally cylindrical and disposed about a socket axis 36 that is generally perpendicular to the support member axis 22. In a preferred embodiment, the socket axis 36 extends in a direction that is generally parallel to a plane that defines the supporting surface of the wheelchair (not illustrated). A circumferential wall 38 extends around the socket portion 30 from an outer wall 31 to the inner wall 33. Preferably, the outer wall 31 is generally perpendicular to the circumferential wall 38. The socket receptacle 30 is preferably provided with a fastener hole 32 to receive a fastener 50, discussed further herein below. The fastener hole 32 is preferably disposed along the socket axis 36 and extends from the outer wall 31 to the inner wall 33. The inner wall 33 defines the interior surface 34. It is preferable that the interior surface 34 is generally concave, having an innermost portion disposed about and partially defining the fastener hole 32. The interior surface 34 is adapted to frictionally engage a socket engaging surface 42, as will be described below in more detail.

With particular reference now to FIGS. 1-5, the swivel element 40 is releasably and adjustably received for pivoting and rotation within the socket receptacle 30. The swivel element 40 is rotatable about the socket axis 36. Additionally, the swivel element 40 is pivotable in any direction at least twenty five degrees away from the socket axis 36. The swivel element 40 includes the socket engaging surface 42, preferably forming a portion of a sphere having a radius 44. The socket engaging surface 42 is preferably a convex counterpart to the concave interior surface 34 of the socket receptacle 30. The swivel element 40 is preferably further provided with a pair of pivot pin holes 46, sized and shaped to receive a pivot pin 48 which pivotally attaches the swivel element 40 to the foot plate support member 70. The pivot pin holes 46 are generally coaxial about a pivot axis 47.

The swivel element 40 is preferably connected to the socket receptacle 30 using a threaded fastener 50. The fastener 50 installs through the socket receptacle fastener hole 32 (see FIG. 4) and through a mating hole (not clearly shown) in the swivel element 40. The fastener 50 is secured using a spherical nut 52 (see FIG. 3). The spherical nut 52 has a generally convex spherical surface. Preferably, the inside surface of the swivel element is generally concave and spherical and adapted to mate with the convex spherical nut 52. The mating hole is larger than the outside diameter of the fastener 50. Therefore, the swivel element 40 is permitted to pivot inside of the socket receptacle, around the fastener 50. The spherical nut 52 is larger than the mating hole and preferably large enough that the convex surface will engage at least a portion of the concave inner surface of the swivel element 40, regardless of the rotation or pivot of the spherical element 40.

It is preferable that when the fastener 50 and nut 52 loosely secure the swivel element 40 within the socket receptacle 30, that the swivel element 40 is rotatable and movable about the socket axis 36 in relation to the socket receptacle 30. Preferably, the swivel element may rotate 360 degrees about the socket axis 36 and pivot in any direction up to at least 25 degrees away from the socket axis 36. When the desired disposition of the swivel element 40 is achieved, the fastener 50 and nut 52 are tightened together, thereby pressing the socket engaging surface 42 into the interior surface 34 of the socket receptacle 30. Preferably, the socket engaging surface 42 frictionally engages the interior surface 34, thereby restricting the movement of the socket engaging surface 42 in relation to the interior surface 34.

Figure 2:
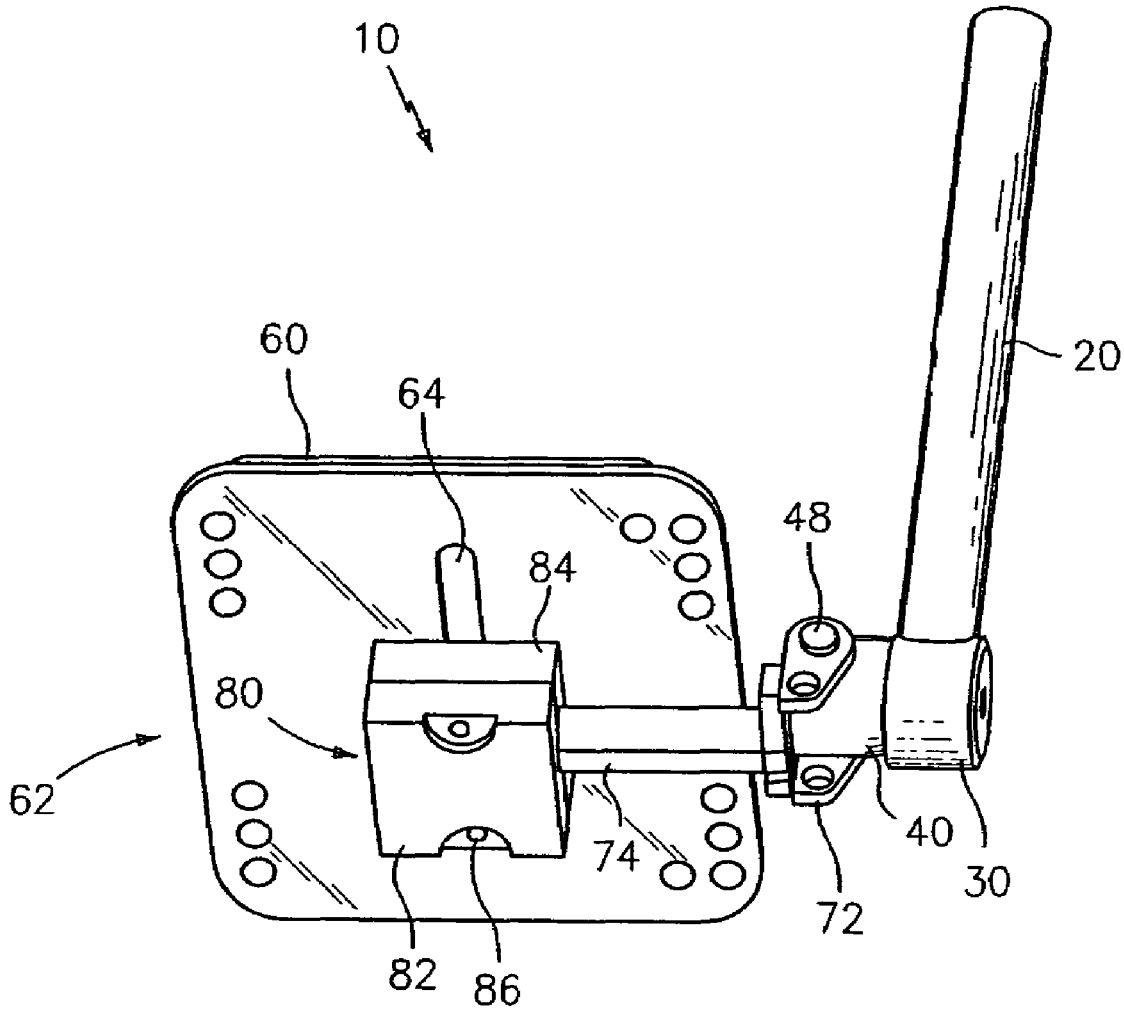
FIG. 2 is a bottom perspective view of the footrest of FIG. 1.
Figure 3:
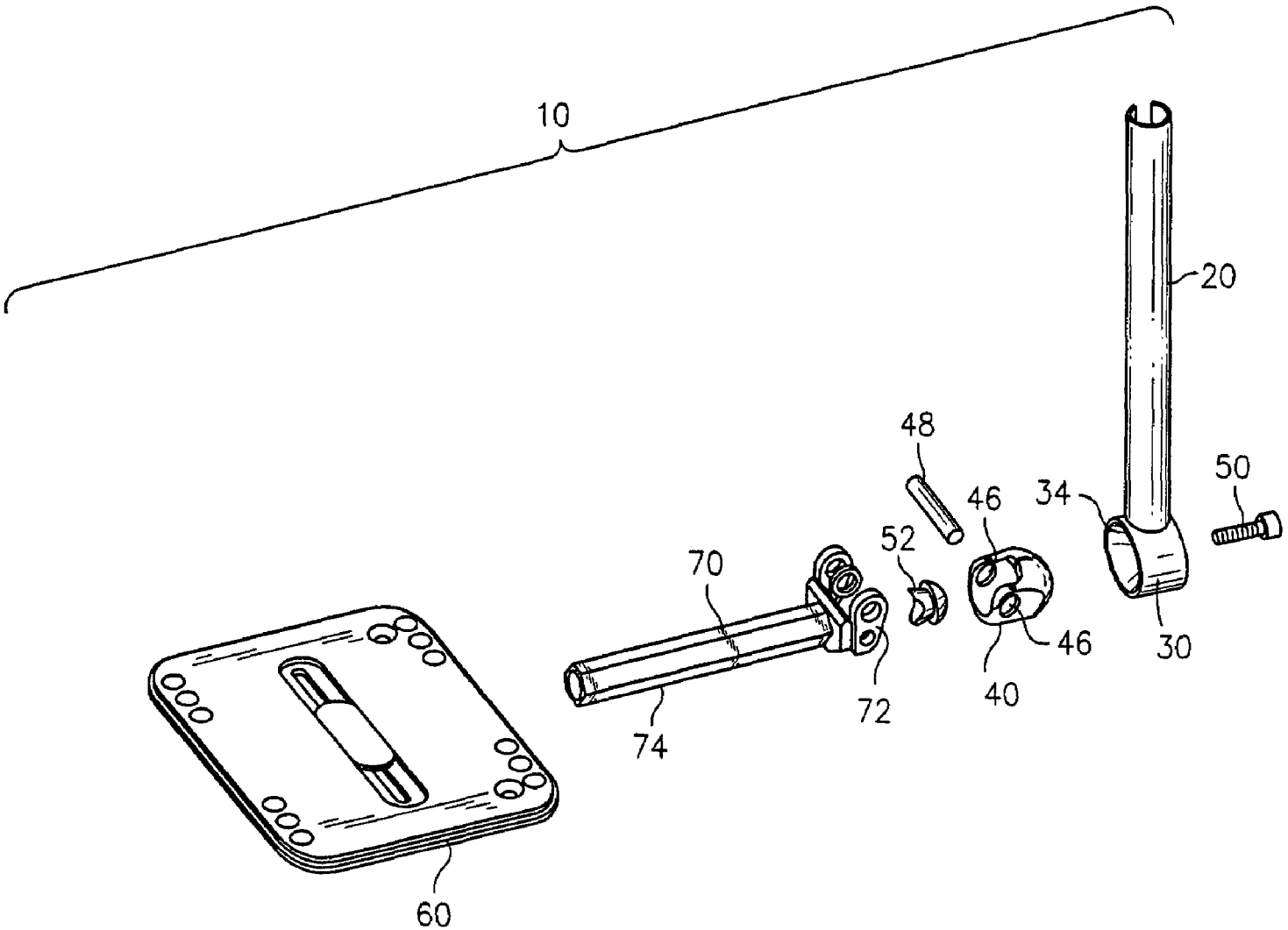
FIG. 3 is an exploded perspective view of the footrest of FIG. 1.
Figure 4:
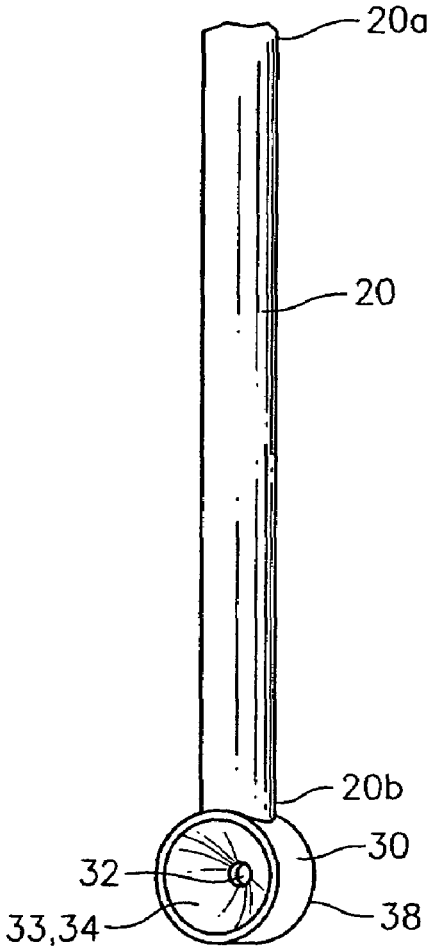
FIG. 4 is a perspective view of a footrest support member and socket receptacle of the footrest of FIG. 1.
Figure 5:
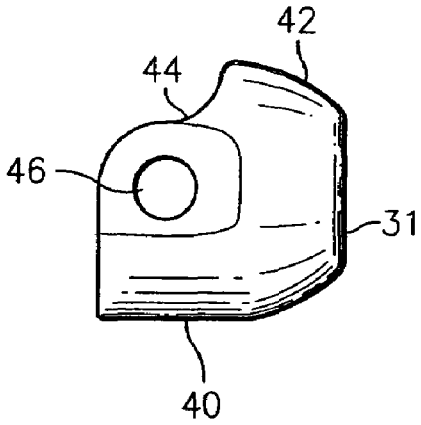
FIG. 5 is a side elevational view of a swivel element of the footrest of FIG. 1.

With continued reference to FIGS. 1-3, the foot plate 60 is connected to the swivel element 40 by a foot plate support member 70. The foot plate support member 70 preferably extends away from the support member 20 in a direction that is generally parallel to the socket axis 36. Preferably, as discussed herein below, the foot plate 60 pivotally connected to the swivel element 40, such that the foot plate 60 is movable between an operative position 62 and a stored position (not illustrated). In the operable position 62, the footplate 60 is generally parallel to the supporting surface of the wheelchair. In the stored position, the foot plate 60 is generally disposed in a plane that is parallel to the support member axis 22. The foot plate 60 provides a generally planar surface of sufficient size to allow a user to comfortably rest his or her foot on the foot plate 60 when the foot plate 60 is in the operative position 62. The foot plate 60 preferably pivots about the pivot axis 47 from the operative position 62 to the stored position.

The foot plate 60 preferably includes an adjustment slot 64, which in conjunction with a foot plate bracket assembly 80, allows the position of the foot plate 60 relative to the foot plate support member 70 to be adjusted. The adjustment slot 64 extends through the foot plate 60 in a direction that is generally perpendicular to the support member 70. The range of motion of the foot plate 60 in relation to the foot plate bracket assembly 80, is generally parallel to the pivot axis 37 or generally away from and closer to the front of the wheelchair.

The foot plate support member 70 is operably connected to the swivel element 40 and also to the foot plate 60. The foot plate support member 70 includes a pivot pin yoke 72 adapted to pivotally receive the swivel element 40 and the pivot pin 48, such that the pivot pin 48 extends through opposing holes in the pivot pin yoke 72 and the pivot pin holes 46 when the swivel element 40 is captured within the pivot pin yoke 72. The foot plate support member 70 further includes a foot plate support member shaft 74. The shaft 74 is captured within the foot plate bracket assembly 80 as described below to secure the foot plate 60 to the foot plate support member 70. Preferably, the shaft 74 has a hexagonally-shaped outer surface, however those skilled in the art will recognize that the shaft 74 may have other profiles as well.

The foot plate bracket assembly 80 includes a first bracket 82 and a second bracket 84. The shaft 74 is captured between the first and second brackets 82, 84. Preferably, together the first and second brackets 82, 84 form a hexagonally-shaped receptacle complimentary in shape and size with the shaft 74. In the preferred embodiment shown here, each of the first and second brackets 82, 84 define three sides of the hexagonal receptacle. The inter-engaging hexagonal shapes of the shaft 74 and the recess formed by the first and second brackets 82, 84 helps prevent unintended rotation of the foot plate 60 relative to the foot plate support member 70.

The first and second brackets 82, 84 connect to a clamp plate 88 by attachment screws 86. In addition to connecting the first and second brackets 82, 84 to the clamp plate 88, the clamp screws 86 facilitate the clamping of the first and second brackets 82, 84 around the foot plate support member 70. The clamp plate 88 is positioned on a first side of the foot plate 60 proximate the adjustment slot 64, while the first and second brackets 82, 84 are positioned on a second side of the foot plate 60. By loosening the attachment screws 86, the foot plate 60 may be moved relative to and/or along the foot plate support member 70 as the foot plate assembly 80 slides relative to the adjustment slot 64.

The footrest 10 comprises conventional materials and is fabricated using conventional manufacturing techniques. In particular, the socket receptacle 30 and swivel element 40 are preferably fabricated from ferrous metals, such as steel. Further, preferably, at least the socket receptacle interior surface 34 and at least the swivel element socket engaging surface 42 are subjected to a ferritic nitrocarburization surface treatment process. The ferritic nitrocarburization surface treatment process is known in the art of metal-working, and may be accomplished using equipment and materials supplied by vendors such as Kolene Corporation, Detroit, Mich. Components treated by this process have surfaces with improved wear and corrosion resistance, and improved fatigue strength. Alternatively, or in addition to the above, the ball and socket may be textured or roughened so as to increase friction between the mating surfaces to increase interlockability.

Figure 6:
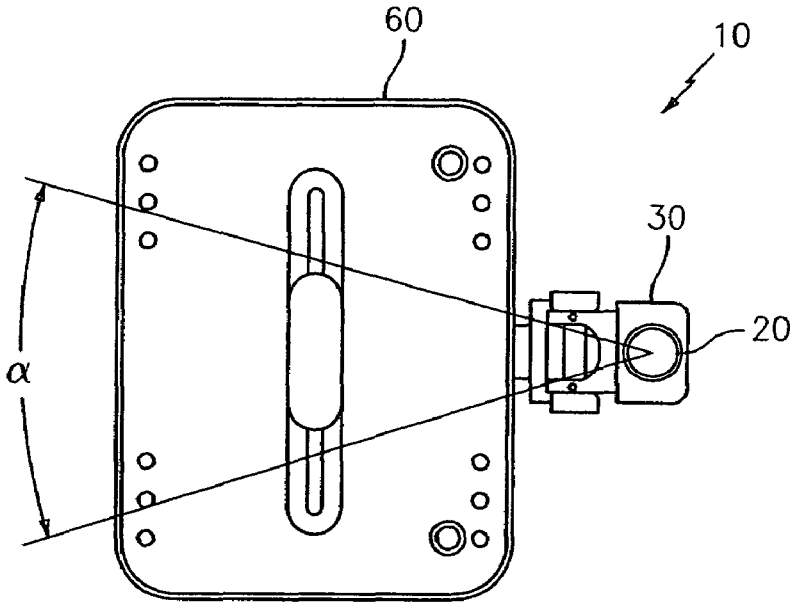
FIG. 6 is a top plan view of the footrest of FIG. 1.
Figure 7:
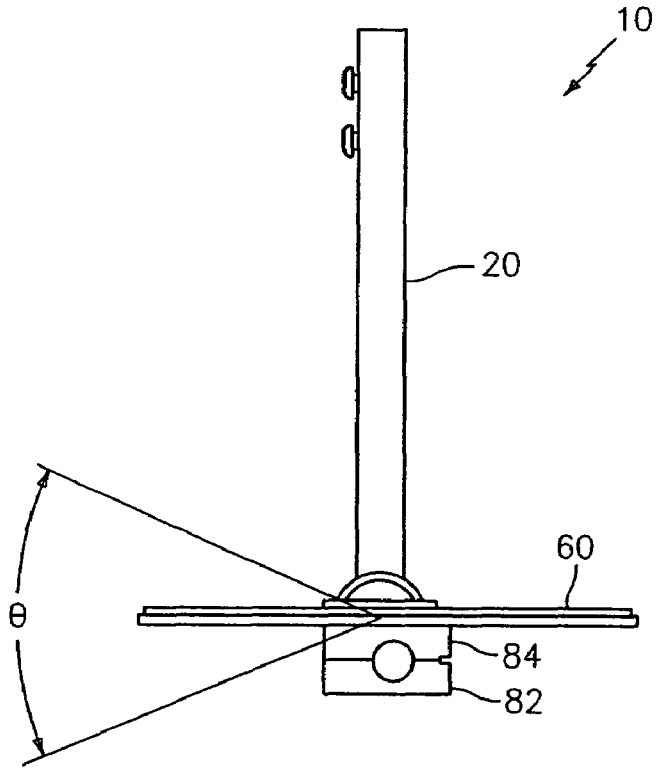
FIG. 7 is a side elevational view of the footrest of FIG. 1.
Figure 8:
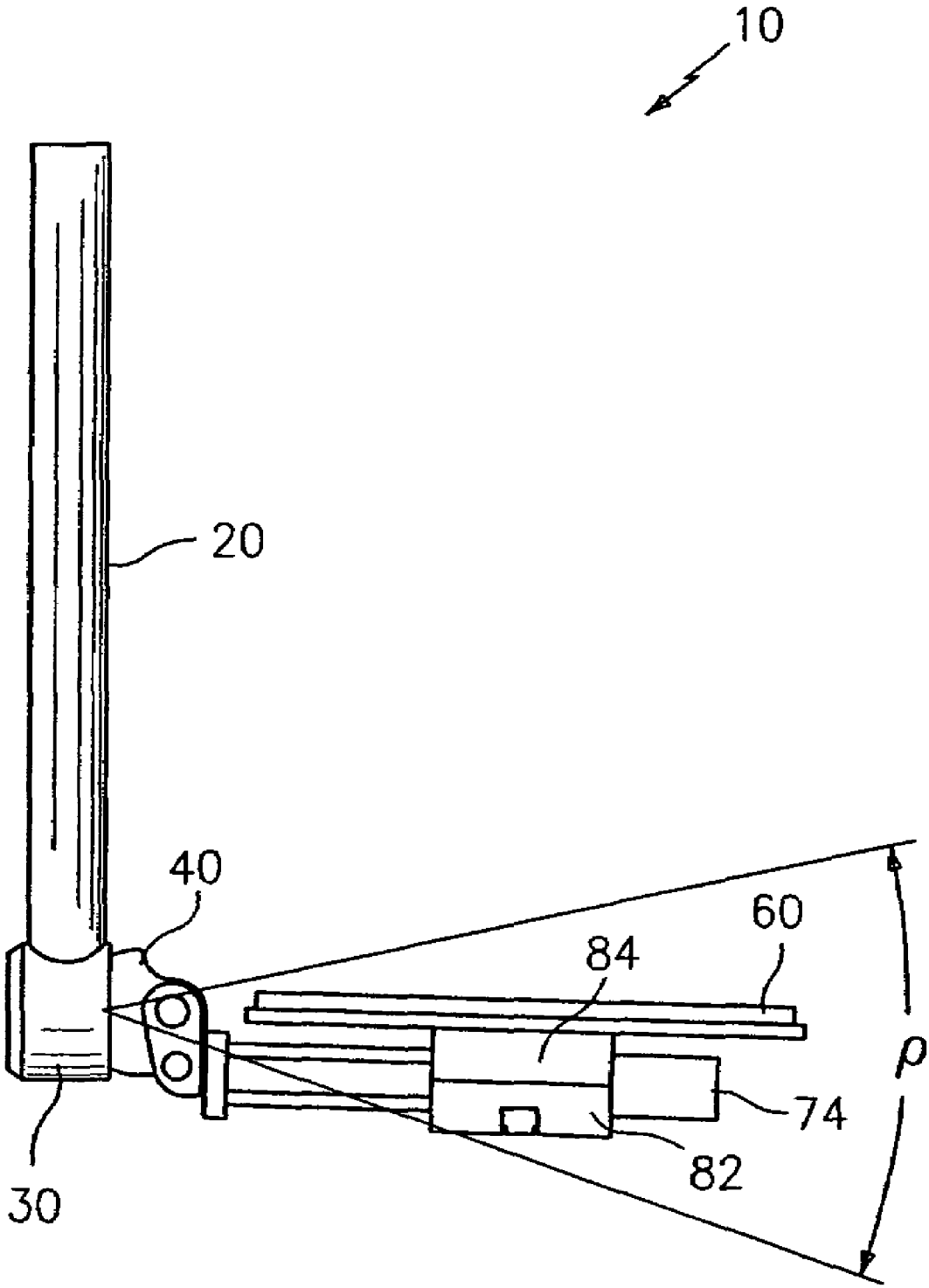
FIG. 8 is a front elevational view of the footrest of FIG. 1.

With reference now to FIGS. 6-8, in operation the position of the swivel element 40, and consequently the position of the foot plate 60, is rotatably adjustable relative to the socket receptacle 30 (and footrest support member 20) in yaw, pitch and roll directions. The foot plate 60 is rotatable through an angle $\alpha$ in the yaw direction (FIG. 6); through an angle $\theta$ in the pitch direction (FIG. 7); and through an angle $\rho$ in the roll direction (FIG. 8). Preferably, the foot plate 60 is rotatable in each of the yaw, pitch, and roll directions through angles $\alpha$, $\theta$, and $\rho$ each of at least 50 degrees. By loosening the fastener 50, the swivel element 40 may be repositioned within the socket receptacle 30 at the desired angular orientation, and then the fastener 50 re-tightened to secure the swivel element 40 and the foot plate 60 in the desired position.

A wheelchair footrest 10 is thus provided having a ball and socket mount providing multiple degree of freedom positional adjustment capability. Furthermore, a ball and socket mount having at least mating surfaces with a ferritic nitrocarburizing surface treatment is further provided.

Although the invention has been described and illustrated with respect to an exemplary embodiment thereof, it should be understood by those skilled in the art that the foregoing and various other changes, omissions and additions may be made therein and thereto, without parting from the spirit and scope of the present invention.

What is claimed is:

1. A wheelchair footrest for use with a wheelchair, comprising:

a footrest support member connectable to the wheelchair, a socket receptacle connected to the footrest support member, the socket receptacle having an interior surface;

a swivel element having a socket engaging surface received within the interior surface for rotation of the swivel element with respect to the socket receptacle;

a fastener releaseably and adjustably fixing the swivel element to the socket, the fastener extending through the interior surface and engaging the swivel element;

a foot plate; and a foot plate support member connected to the swivel element and further connected to the foot plate, wherein the position of the swivel element is rotatably adjustable relative to the socket receptacle in yaw, pitch and roll directions.

2. The wheelchair footrest of claim 1 wherein the socket receptacle is fixedly connected to the footrest support member.

3. The wheelchair footrest of claim 1 wherein the socket engaging surface forms a portion of a sphere and wherein the interior surface is sized and shaped to mate with the socket engaging surface.

4. A wheelchair footrest for use with a wheelchair, comprising:

a footrest support member connectable to the wheelchair, a socket receptacle connected to the footrest support member;

a swivel element releaseably and adjustably received for rotation within the socket receptacle;

a foot plate; and a foot plate support member connected to the swivel element and further connected to the foot plate, wherein the position of the swivel element is rotatably adjustable relative to the socket receptacle in yaw, pitch and roll directions, wherein the swivel element has a socket engaging surface forming a portion of a sphere and the socket receptacle has an interior surface sized and shaped to mate with the socket engaging surface, and wherein the socket receptacle and the swivel element are fabricated from ferrous metals, and at least the interior surface of the socket receptacle and at least the socket engaging surface of the swivel element are subjected to a ferritic nitrocarburization surface treatment process.

5. The wheelchair footrest of claim 1 wherein the swivel element is rotatably adjustable relative to the socket in each of the yaw, pitch, and roll directions over an angular range of at least 50 degrees.

6. The wheelchair footrest of claim 1 wherein the fastener comprises a threaded fastener that releaseably connects to a threaded nut secured within the socket receptacle.

7. The wheelchair footrest of claim 1 further comprising a foot plate bracket releaseably connecting the foot plate support member to the foot plate, and the foot plate having an adjustment slot, wherein a position of the foot plate relative to the foot plate support member is adjustable.

8. The wheelchair footrest of claim 1 wherein the foot plate support member is pivotally coupled to the swivel element for rotation between an operative position and a stored position.

9. A wheelchair comprising:

a frame, a seat supported on the frame, at least two wheels supporting the frame, and a footrest attached to the frame, the footrest comprising a socket fixedly attached to the frame, a ball joint pivotably and releaseably secured within the socket, and a foot plate slidably attached to a foot plate support, the foot plate support attached to the ball joint and rotatably supported by the ball joint in the socket.

10. The wheelchair of claim 9 wherein the ball joint is at least partially disposed within the socket.

11. A wheelchair comprising:

a frame, a seat supported on the frame, at least two wheels supporting the frame, and a footrest attached to the frame, the footrest having a socket fixedly attached to the frame and pivotably attached to a ball joint, a foot plate slidably attached to a foot plate support, and the foot plate support rotatably attached to the ball joint, wherein the ball joint is at least partially disposed within the socket, and wherein the ball joint is retained within the socket by a connector extending through both of the ball joint and the socket.

12. The wheelchair of claim 9 wherein the ball joint is pivotable within the socket for at least 25 degrees in each direction.

13. The wheelchair of claim 9 wherein the foot plate support is rotatable from a supporting position to a stored position.

14. The wheelchair of claim 13 wherein the foot plate support is generally perpendicular to a supporting surface of the wheelchair in the stored position and generally parallel to the supporting surface in the supporting position.

15. The wheelchair of claim 9 wherein the socket and the ball joint are fabricated from ferrous metals, and at least an interior surface of the socket and an exterior surface of the ball joint are subjected to a ferritic nitrocarburization surface treatment process.

16. A mount for mounting a foot plate to the frame of a wheelchair comprising:

a socket receptacle connected to the frame;

a swivel element disposed proximate to the socket receptacle and releaseably engagable with the socket receptacle;

a foot plate support member, having a first end pivotally connected to the swivel element and a second end disposed distal the first end;

a foot plate bracket assembly longitudinally translatable along the foot plate support member between the first end and the second end; and a clamp plate disposed on the foot plate bracket assembly, wherein the swivel element is swivelable at least twenty five degrees in any direction, and wherein the foot plate is laterally translatable relative to the foot plate support member.

17. The mount of claim 16 wherein the socket receptacle is slidable along the frame.

18. The mount of claim 16 wherein the socket receptacle and the swivel element are fabricated from ferrous metals, and at least an interior surface of the socket receptacle and an exterior surface of the swivel element are subjected to a ferritic nitrocarburization surface treatment process.

19. The wheelchair footrest of claim 1 wherein the fastener comprises a threaded fastener that releaseably connects to a threaded nut secured within the swivel element, wherein the threaded nut comprises a convex outer surface and wherein the nut resides within a concave mating surface within the swivel element.

20. The wheelchair footrest of claim 19 further comprising means for pivotably attaching the foot plate support member to the swivel element for pivotable rotation of the foot plate support member between an operating position and a stored position.

21. The wheelchair footrest of claim 20 wherein the pivoting means comprises a pair of pivot holes on the swivel element, and a pivot pin positioned within the pivot hole forming a pivot axis for the foot plate support member.

22. A wheelchair footrest as claimed in claim 1 wherein the interior surface of the socket receptacle comprises a concave surface, and the socket engaging surface of the swivel element forms a convex surface sized and shaped to mate with the concave surface of the interior of the socket receptacle.

23. The wheelchair footrest of claim 22 wherein the swivel element further comprises a concave mating surface and a fastener nut, the nut having a convex outer surface received within the concave mating surface of the swivel element, the fastener releaseably securing the swivel element within the interior surface of the socket receptacle by engagement with the fastener nut.

* * * * *